US006453647B1

(12) United States Patent
Adams et al.

(10) Patent No.: US 6,453,647 B1
(45) Date of Patent: Sep. 24, 2002

(54) TABLETOP INSERTER PROVIDING SHEET ACCUMULATION

(75) Inventors: Paul A. Adams, Essex (GB); Martyn R. House, Hertfordshire (GB)

(73) Assignee: Pitney Bowes Inc., Stamford, CT (US)

( * ) Notice: Subject to any disclaimer, the term of this patent is extended or adjusted under 35 U.S.C. 154(b) by 0 days.

(21) Appl. No.: 09/222,194

(22) Filed: Dec. 29, 1998

(51) Int. Cl.[7] ..... B65B 11/48

(52) U.S. Cl. ..... 53/460; 53/569; 271/303; 493/414

(58) Field of Search ..... 53/460, 569; 271/3.03, 271/3.01, 303; 493/216, 248, 405, 414, 415

(56) References Cited

U.S. PATENT DOCUMENTS

| | | | | |
|---|---|---|---|---|
| 5,054,757 A | * | 10/1991 | Martin et al. | 270/45 |
| 5,183,250 A | * | 2/1993 | Miller et al. | 271/222 |
| 5,258,817 A | * | 11/1993 | Acquaviva | 355/320 |
| 5,333,437 A | * | 8/1994 | Conti | 53/284.3 |
| 5,410,860 A | * | 5/1995 | Coudray et al. | 53/569 |
| 5,414,977 A | * | 5/1995 | Cohen | 53/460 |
| 5,415,068 A | * | 5/1995 | Marzullo | 53/381.5 |
| 5,476,255 A | * | 12/1995 | Murcko et al. | 271/109 |
| 5,735,516 A | * | 4/1998 | Gerlier et al. | 209/534 |
| 5,785,638 A | * | 7/1998 | Bristo et al. | 493/420 |
| 5,992,132 A | * | 11/1999 | Auerbach | 53/569 |

FOREIGN PATENT DOCUMENTS

| | | |
|---|---|---|
| GB | 1222432 | 3/1969 |
| GB | 2292937 | 3/1996 |

* cited by examiner

*Primary Examiner*—Rinialdi I. Rada
*Assistant Examiner*—Christopher R Harmon
(74) *Attorney, Agent, or Firm*—Christopher J. Capelli; Angelo N. Chaclas

(57) ABSTRACT

An inserter system for inserting folded sheets into an envelope providing at least one sheet feeding station for feeding individual sheets and an accumulation station in communication with the at least one sheet feeding station having a curved paper path wherein individual sheets are fed into the curved paper path from the at least one sheet feeding station and are accumulated therewithin. A folding station is in communication with the accumulation station for receiving an accumulation of sheets from the curved paper path for folding the accumulation of sheets.

5 Claims, 3 Drawing Sheets

TABLETOP INSERTER PROVIDING SHEET ACCUMULATION

FIELD OF THE INVENTION

This invention relates to an inserter for inserting documents into envelopes, and more particularly to a tabletop inserter providing sheet accumulation.

BACKGROUND OF THE INVENTION

Document inserting systems generally include a plurality of various stations that are each configured for a specific task. For instance, an inserter system typically includes at least one sheet feeding mechanism for supplying a sheet from a supply. Preferably an inserter system includes a collating mechanism located downstream of the sheet feeding mechanism that is functional to collate one or more sheets designated to be inserted into an envelope. A folding mechanism is usually located downstream of the collating mechanism and is operational to fold the sheet collation in a prescribed format. Examples of such folded formats include a z-fold, a c-fold, a half-fold, double-fold, etc. An insertion station is typically located downstream of the folding mechanism and is operational to insert the folded collation into a waiting open envelope.

Inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such high volume inserter systems are the 8, 9 and 14 series inserter systems available from Pitney Bowes, Inc., Stamford, Conn.

However, inserter systems are not limited to such high volume applications as they also have considerable utility in lower volume applications, such as SOHO (small office/home office) applications. An example of such a SOHO inserter system is the tabletop 3 Series inserter system available from Pitney Bowes. This tabletop inserter system has been designed for implementation on an tabletop surface while providing many automated features and requiring little maintenance. In other words, it has been designed to be operated by an ordinary office worker with little or no training in operating inserter systems. Therefore, regarding the operation of such inserters, it is critical that they provide a small footprint so as to require as little space as possible.

A known difficulty associated with reducing the size of a tabletop inserter is doing so in such a manner while maintaining the features of larger sized inserters. One such important feature is an accumulator, which operates to accumulate seriatim fed sheets into accumulation groups having a predetermined number of sheets.

Therefore it is an object of the present invention to provide a tabletop inserter having a sheet accumulator.

SUMMARY OF THE INVENTION

Accordingly the present invention relates to an tabletop inserter system for inserting folded sheets into an envelope, which tabletop inserter system includes at least one sheet feeding station for feeding individual sheets. Further included is an accumulation station in communication with the at least one sheet feeding station having a curved paper path wherein individual sheets are fed into the curved paper path from the at least one sheet feeding station and are accumulated therewithin.

The accumulation station includes a pivotable collating gate movable between a first position providing a paper path between the at least one sheet feeding station and a first entrance end of the curved paper path and a second position providing a paper path between a second exit end of the curved paper path and the sheet folding station. The accumulation station further includes a pivotable accumulating gate mounted in proximity to the second exit end of the curved paper path, which accumulating gate is movable between a first position providing a closed end at the second end of the curved paper path for accumulating sheets in the curved paper path and a second position providing an open end at the second end of the curved paper path for a sheets that have accumulated within the curved paper path of the accumulation station.

BRIEF DESCRIPTION OF THE DRAWINGS

The above and other objects and advantages of the present invention will become more readily apparent upon consideration of the following detailed description, taken in conjunction with the accompanying drawings, in which like reference characters refer to like parts throughout the drawings and in which.

DETAILED DESCRIPTION OF A PREFERRED EMBODIMENT

Figure 1:
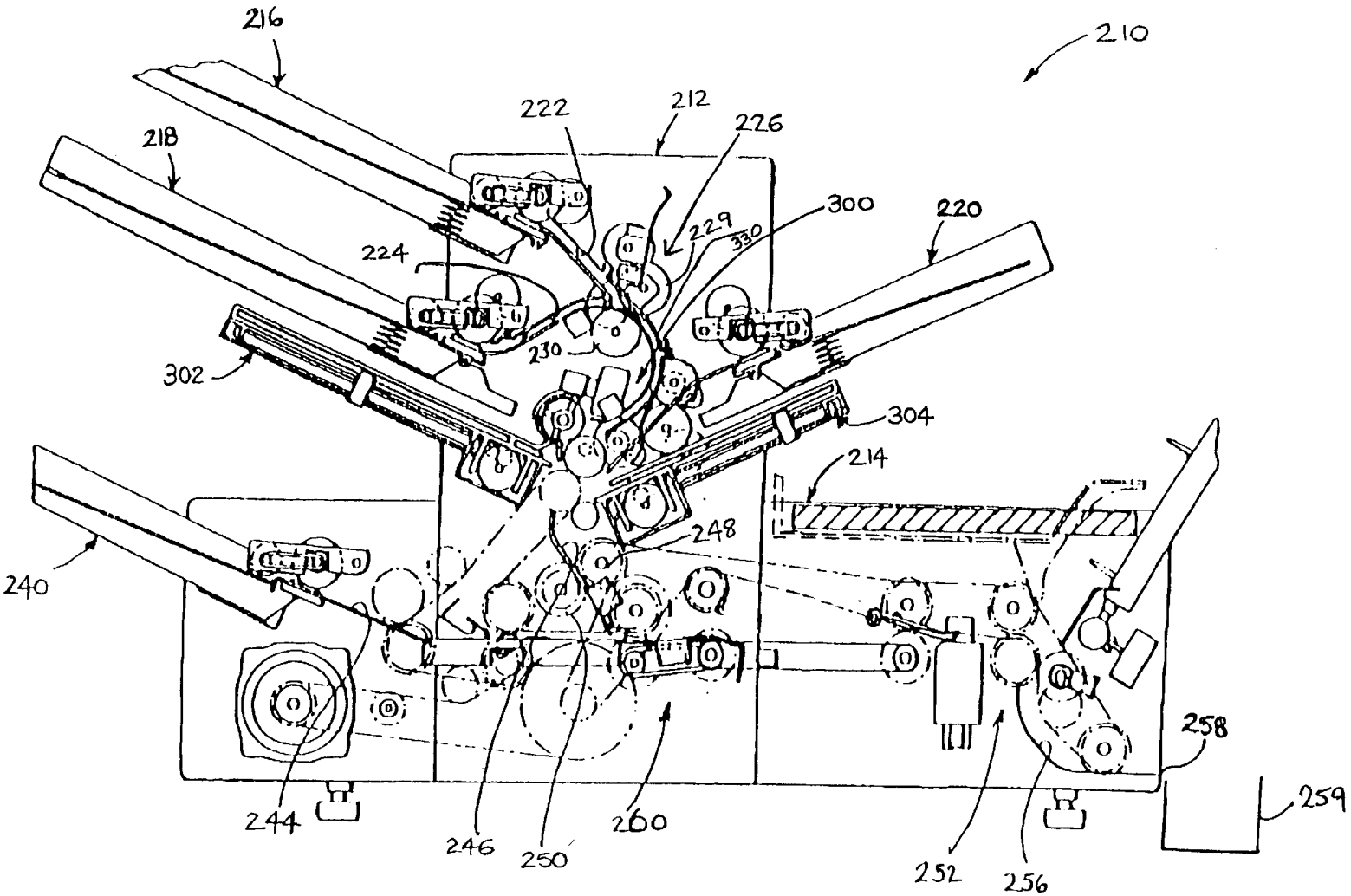
FIG. 1 is an elevational view of a document inserting system forming an embodiment of the present invention.

Reference is made to the drawings, wherein there is seen in FIG. 1 an elevational view of a tabletop inserter, designated generally at 210, which embodies the radial collation configuration 300 of the present invention as discussed further below in reference to FIGS. 2 and 3. A brief description of the tabletop inserter 210 will now be given.

With reference to FIG. 1, tabletop inserter 210 generally consists of an upper housing 212 mounted atop a lower housing 214. Upper housing 212 generally includes first and second sheet feeders 216 and 218, and preferably an insert feeder 220. Individual sheets are preferably conveyed from each sheet feeder 216 and 218 into respectively first and second feed paths 222 and 224. The first and second sheet paths 222 and 224 merge with one another at a collation station 226 having first and second collating rollers 229 and 230. The collating station 226 is operative to align the leading edges of first and second sheets being respectively conveyed from the first and second sheet feeders 216 and 218, via the first and second sheet paths 222 and 224, within the nip formed between the collating rollers 229 and 230. Once aligned, the collating rollers 229 and 230 are actuated to simultaneously feed the aligned sheets in a supply path 232 downstream of the collating station 226. These aligned sheets are also known as a "collation". This sheet collation is then conveyed downstream in the supply path 232 to the folding station 300.

Like conventional folding stations, the folding station is configured to fold the sheet collation in prescribed configurations, such as C-fold, Z-fold, Half-fold, Double-fold, etc. In this constructional example, the folding station 300 comprises a first fold plate 302 and a second fold plate 304. It includes a diverter which is operable for diverting a sheet approaching the first fold plate 302 directly to the second fold plate 304. Depending on the setting of the diverter, the type of fold that is made can be selected. After a collation is folded in the folding.station 300, the folded collation is then conveyed to the lower housing 214 of the inserter system 210 for further processing.

The lower housing 214 of inserter system 210 includes an envelope supply station 240 connecting to an insertion station 120. The envelope supply station 240 contains a supply of envelopes stored with their flaps in their closed (but unsealed) condition. These envelopes are fed to the insertion station 260, via envelope feed path 244 preferably. Each envelope flap is opened by a suitable flap opening device such as are well known in the art, while in transit on the envelope feed path from the envelope supply station 240 to the insertion station 260. Once received in the insertion station, the envelope has its mouth opened, in preparation for insertion of the aforesaid folded collation being conveyed from the folding station 300. Thus, the folded collation is transported from the folding station 300 to the insertion station 260, via a collation transport path 246 connecting the latter two stations. Preferably the collation transport path 246 includes a pair of conveying rollers 248 and 250 for conveying a folded collation along the transport path 246.

The lower housing 214 further includes a sealing station 252 located downstream of the insertion station 260, which sealing station 252 is operative to seal an open envelope received from the insertion station 260. An envelope insertion path connects the insertion station 260 to the sealing station 252. An envelope output path 256 is connected to the sealing station 252 and is operative to convey sealed envelopes from the sealing station 252 through an output opening 258 provided in the lower housing 214 of the insertion system 210. After a sealed envelope has exited from the output opening 258, appropriate postage can then be applied for delivery to a recipient.

As is conventional, inserter system 210 includes a control system (not shown in FIG. 1) for controlling the various components implemented in the inserter system. It is to be appreciated that the control system is to encompass a computer processor driven system. Further, it is to be appreciated that the first sheet feeder 216 includes a sensor system 310 (FIG. 2) for preferably performing Optical Character Recognition (OCR) functions on sheets being fed from the first sheet feeder 216, as will be discussed further below.

With the general structure of inserter system 210 being described above, a more specific description will now be given with reference to a radial collation configuration in accordance with the present invention, designated generally at 300, that is understood to be incorporated in the inserter system 210 of FIG. 1.

Figure 2:
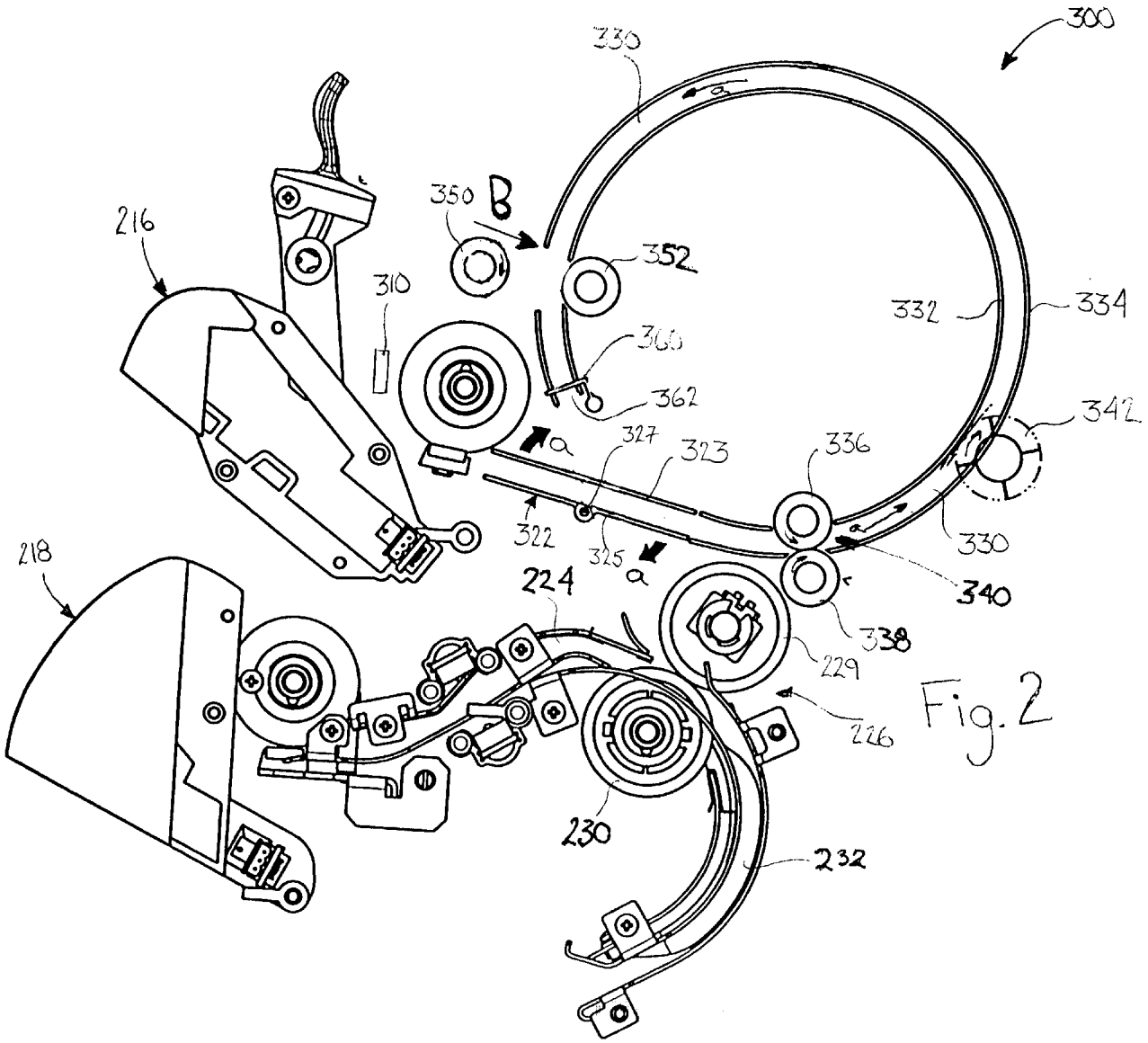
FIGS. 2 and 3 are partial elevational views of FIG. 1 depicting the document inserting system having the radial collation configuration for accumulating sheets in accordance with the present invention.

In the radial collation configuration embodiment of FIG. 2, the first sheet path 222 of FIG. 1 has been replaced with a pivotable collating diverter 322 having spaced apart parallel walls 323, 325 that is movable between a first collating position (FIG. 2) and a second feeding position (FIG. 3) about pivot point 327. When the collating diverter 322 is positioned in it's collating position (FIG. 2), sheets are feed from the first sheet feeder 216 into and through the collating diverter 322 and into the radial collation path 330. When the collating diverter 322 is positioned in it's second feeding position (FIG. 3), sheets that have been accumulated in the radial collation path 330 are then enabled to be simultaneously conveyed into the collating station 226, via the collating diverter 322, as will be further discussed below.

The radial collation path 330 is defined by spaced apart parallel inner and outer curved radial walls 332 and 334. Extending through cutouts preferably provided in the inner and outer walls 332, 334 are first and second drive rollers 336 and 338 forming a drive nip 340 within the radial collation path 330. Downstream of the drive rollers 336, 338 (along the path defined by arrow "a") in the radial collation path 330 is an urge roller 342 preferably extending through a cutout formed in the outer wall 334 of the radial collation path 330, the functionality of which will be appreciated from the below discussion of the operation of the radial collation configuration 300.

Downstream of the urge roller 342, and extending through cutouts formed in the inner and outer radial walls 332, 334 of the collation path 330, are first and second radial drive rollers 350 and 352 in which the first radial drive roller 350 is movable between a proximal position (FIG. 3) and actuated distal position (FIG. 2) relative to the second radial drive roller 352. When the first radial drive roller 350 is positioned in it's proximal position (FIG. 3) a drive nip formed between the first and second radial drive rollers 350 and 352 in the radial collation path 330, the functionality of which will also be appreciated from the below discussion of the operation of the radial collation configuration 300.

Figure 3:
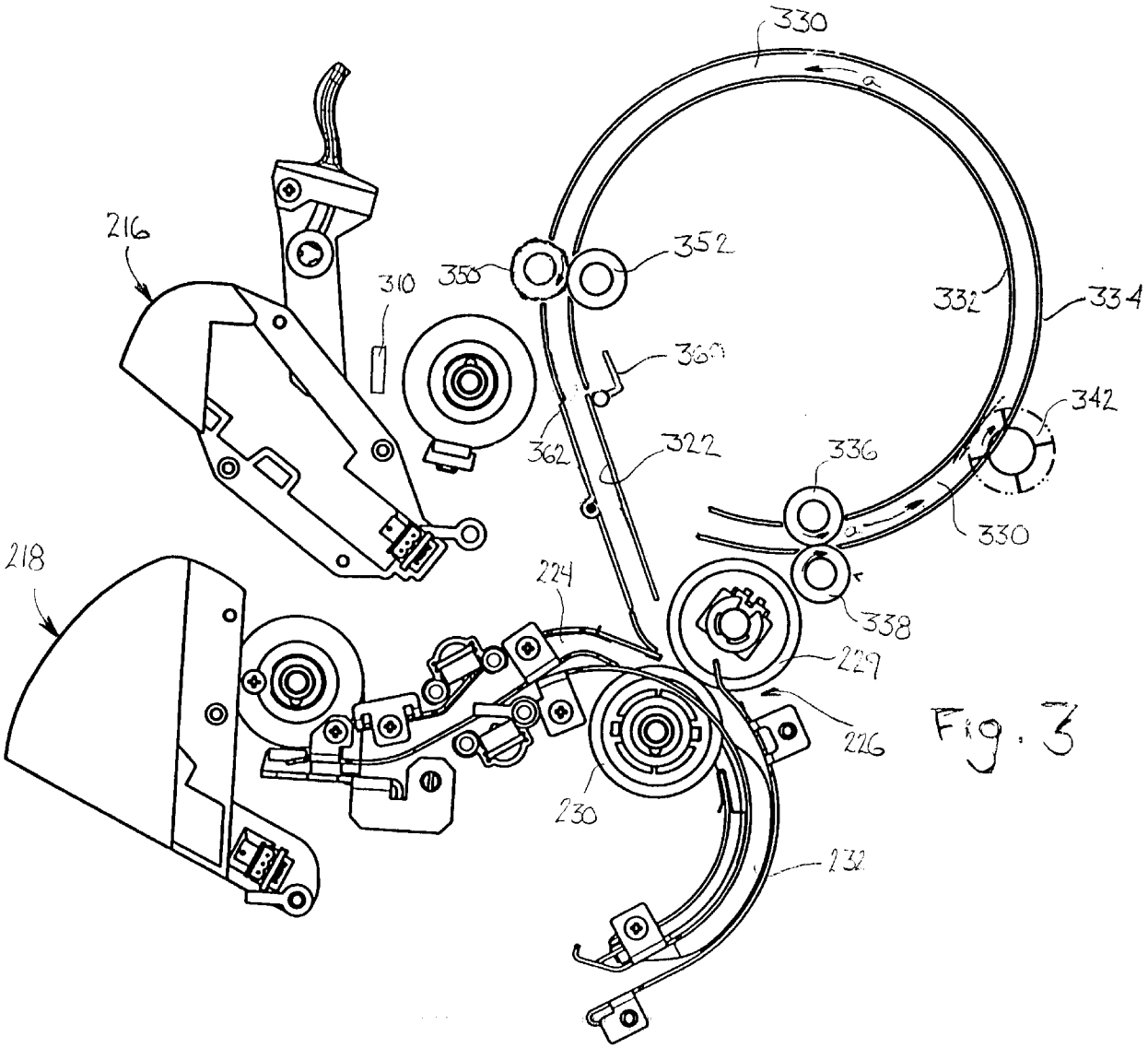

A pivotable accumulation gate 360 is positioned in proximity to the open end 352 of the radial collation path 330 and is movable between an accumulating position (FIG. 2) and a feeding position (FIG. 3). When the accumulating gate 360 is positioned in it's accumulating position (FIG. 2) the leading edges of sheets are caused to abut against the accumulating gate 360, such that sheets fed from the first feeding station 216 are caused to accumulate within the radial collation path 330. Conversely, when the accumulating gate 360 is positioned in it's feeding position (FIG. 3) sheets that have accumulated within the radial collation path 330 are unencumbered so as to be simultaneously fed into the collation station 226, as will be discussed further below.

With the system components of the radial collation configuration being discussed above, its method of operation will now be discussed.

With reference to FIG. 2, and with the collating diverter 322 positioned in it's collating position, the radial drive roller 350 positioned in it's distal position and the accumulating gate 360 positioned in it's accumulating position, a sheet is fed from the first sheet feeder 216 such that it travels through the collating diverter 322 and through the drive nip 340 of rollers 336 and 338 and into the radial collation path 330. The drive nip 340 provides drive to the sheet feeding through the collating diverter 322 so as to further the advancement of the sheet in the radial collation path 330. The conveying sheet passes the urge roller 342 and continues to travel through the radial collation path 330 until the leading edge of the sheet abuts against the accumulating gate 360. It is to be appreciated that once the leading edge of the sheet is registered against the accumulating gate 360, the trailing edge is to be understood to have cleared the drive nip 340 but resides in engagement with the urge roller 342, which urge roller 342 is functional to maintain the leading edge of the aforesaid fed sheet in registration with the accumulating gate 360. The urge roller 342 is further operational to hold the trailing edge of the aforesaid sheet against the inner wall 332 of the radial collation path 330 so as to protect this trailing edge and ensure that a subsequent fed sheet is maintained in the proper grouping order when more than one sheet is caused to accumulate within the radial collation path 330, as discussed below.

With the aforesaid first sheet being maintained in the radial collation path 330, subsequent sheets may then be caused to be individually fed into the radial collation path 330 from the first sheet feeder 216 as previously described above so as to accumulate within the radial collation path 330. It is to be understood that each accumulated sheet in the radial collation path 330 has its leading edge registered against the accumulating gate 360 and its trailing edge in engagement with the urge roller 342.

After a predetermined amount of sheets have accumulated within the radial collation path 330, and with reference to FIG. 3, and with the collating diverter 322 positioned in it's feeding position, the radial drive roller 350 positioned in it's actuated proximal position and the accumulating gate 360 positioned in it's feeding position, the drive nip 353 effected between the radial drive rollers 350 and 352 causes the sheet accumulation to convey through the collating diverter 322 and into the nip formed between the collating rollers 229 and 230 of the collating station 226. The aforesaid sheet accumulation may then be collated with a sheet fed from the second sheet feeder 218, whereafter the aforesaid sheet accumulation conveys through the supply path 232 and into the folding station 300 (FIG. 1) for further processing. Thereafter, the collation, configuration 300 is returned to its configuration of FIG. 2 so as to initiate another sheet accumulation task, as discussed above.

It is to be appreciated that a sensor system 310 mounted in proximity to the first sheet feeder 216 preferably controls the sheet accumulation count in the radial collation path 330 by counting the number of sheets that have been fed from the first sheet feeder 216 and are accumulated within the radial collation path 330. Once a predetermined number of sheets have been accumulated, the control system of the inserter system 210 causes the feeding of the sheet accumulation from the radial collation path 330 and into the collation station 226, as discussed above. The sensor system 310 may also perform Optical Character Recognition functions so as to read markings from a control sheet being feed from the first sheet feeder 216, which markings inform the control system as to how many sheets are to be accumulated with the radial collation path 330 for a sheet group associated with the control sheet. Thus, a varying number of sheets may be caused to accumulate within the radial collation path 330 in dependence upon the markings of the control sheet for each accumulation group. It is also to be understood that the control system of the inserter system 210 also preferably controls the movement and operation of the various described components of the aforesaid collation configuration 300.

In summary, a radial collation configuration 300 for accumulating sheets in a tabletop inserter has been described. Although the present invention has been described with emphasis on a particular embodiment, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. An inserter system for inserting folded sheets into an envelope, the inserter system comprising:

at least one sheet feeding station for feeding individual sheets;

an accumulation station in communication with the at least one sheet feeding station including a curved paper path having a first end and a second end wherein individual sheets are fed into the first end of the curved paper path from the at least one sheet feeding station and are accumulated within the curved paper path; and a folding station in communication with the accumulation station for receiving an accumulation of sheets from the second end of the curved paper path and folding the accumulation of sheets, wherein the accumulation station further includes a pivotable collating gate movable between a first position providing a first paper path between the at least one sheet feeding station and the first end of the curved paper path and a second position providing a second paper path between the second end of the curved paper path and the folding station;

wherein the accumulation station further includes a pivotable accumulating gate mounted in proximity to the second end of the curved paper path that is movable between a first position providing a closed end at the second end of the curved paper path for accumulating sheets in the curved paper path and a second position providing an open end at the second end of the curved paper path;

wherein the accumulation station further includes a pair of drive rollers having a drive nip positioned in the curved paper path in proximity to the first end of the curved paper path for conveying sheets in the curved paper path toward the second end of the curved paper path; and wherein the accumulation station further includes first and second radial drive rollers mounted in proximity to the second end of the curved paper path wherein the first radial drive roller is movable between a first position forming a drive nip with the second radial drive roller in the curved paper path and a second position in which the radial drive roller is moved away from the second radial drive roller.

2. The inserter system as recited in claim 1 further comprising:

a second sheet feeding station; and a collating station in communication with the second sheet feeding station and the second end of the curved paper path.

3. An inserter system for inserting folded sheets into an envelope, the inserter system comprising:

at least one sheet feeding station for feeding individual sheets;

an accumulation station in communication with the at least one sheet feeding station including a curved paper path having a first end and a second end wherein individual sheets are fed into the first end of the curved paper path from the at least one sheet feeding station and are accumulated within the curved paper path; and a folding station in communication with the accumulation station for receiving an accumulation of sheets from the second end of the curved paper path and folding the accumulation of sheets, wherein the accumulation station further includes a pivotable collating gate movable between a first position providing a first paper path between the at least one sheet feeding station and the first end of the curved paper path and a second position providing a second paper path between the second end of the curved paper path and the folding station; and wherein said pivotable collating gate comprises spaced apart parallel walls.

4. An inserter system claimed in claim 3, wherein said pivotable collating gate pivots about a pivot point.

5. The inserter system as recited in claim 3 further comprising:

a second sheet feeding station; and a collating station in communication with the second sheet feeding station and the second end of the curved paper path.

* * * * *